United States Patent [19]

Mermelstein

[11] 4,021,045

[45] May 3, 1977

[54] GAME PIECE RETAINING

[76] Inventor: Seymour Mermelstein, 223 Park St., Newton, Mass. 02158

[22] Filed: May 10, 1976

[21] Appl. No.: 684,658

[52] U.S. Cl. ..... 273/136 D; 273/136 K

[51] Int. Cl.[2] ..... A63F 3/02

[58] Field of Search ..... 273/136 D, 136 E, 136 K, 273/136 H, 131 B; 35/73

[56] References Cited

UNITED STATES PATENTS

| | | | |
|---|---|---|---|
| 715,794 | 12/1902 | Haskell | 273/136 K |
| 887,342 | 5/1908 | McLane | 35/73 |
| 2,379,465 | 7/1945 | Vollmer | 273/131 B |
| 2,584,601 | 2/1952 | Mauser | 35/73 |

FOREIGN PATENTS OR APPLICATIONS

| | | | |
|---|---|---|---|
| 148,495 | 2/1904 | Germany | 273/136 D |
| 155,033 | 12/1920 | United Kingdom | 273/136 K |

*Primary Examiner*—Richard C. Pinkham
*Assistant Examiner*—Harry G. Strappello
*Attorney, Agent, or Firm*—Charles Hieken; Jerry Cohen

[57] ABSTRACT

A chess or checker board has individual blocks for each square enclosed by a raisable normally recessed lattice or egg-crate structure.

7 Claims, 10 Drawing Figures

FIG. 3
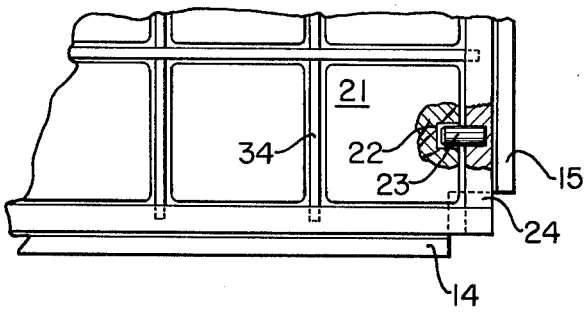
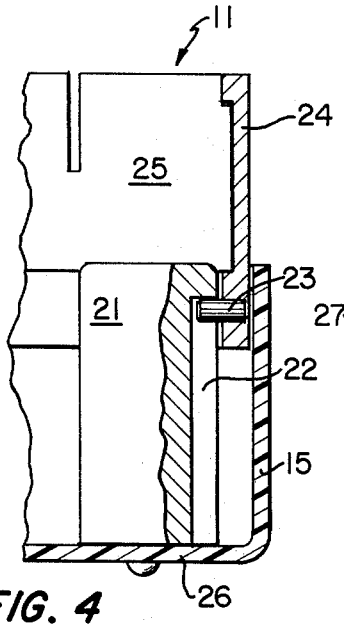
FIG. 4
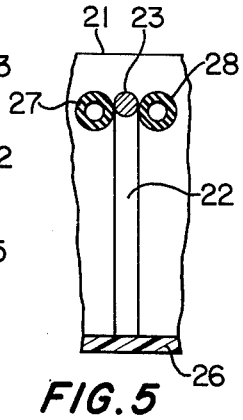
FIG. 5
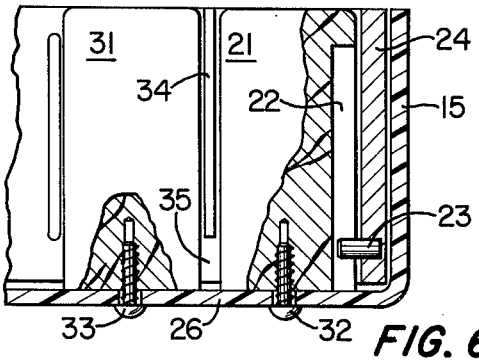
FIG. 6
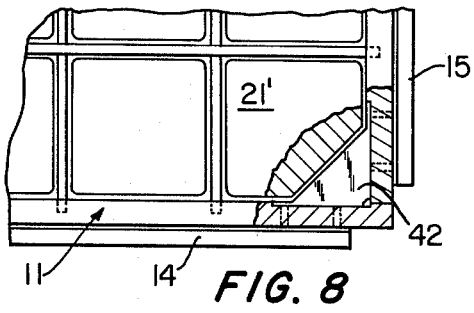
FIG. 8
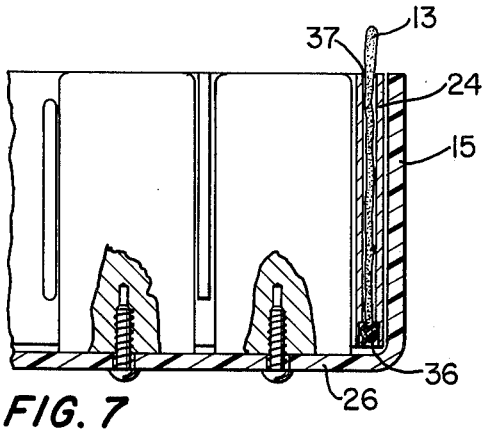
FIG. 7
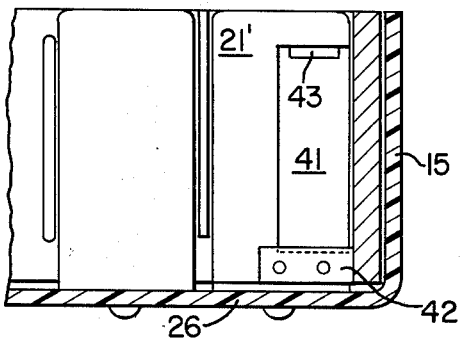
FIG. 10
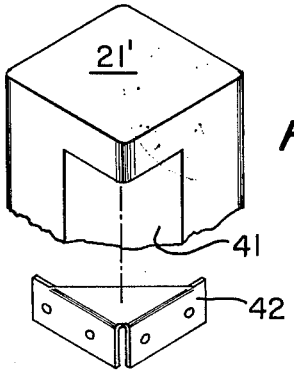
FIG. 9

GAME PIECE RETAINING

BACKGROUND OF THE INVENTION

The present invention relates in general to game piece retaining and more particularly concerns novel apparatus and techniques for providing an attractive checker or chess board for play and includes convenient means for both retaining the game pieces in position when the game is adjourned and for carrying the assembly with the pieces retained from a playing surface to a storage area and back to the playing area. The invention is easily operated by relatively unskilled personnel for many cycles of operation without interfering with movement of the pieces during play.

A game of chess not infrequently takes a long time. Players with limited time adjourn a game for resumption later. One problem resides in keeping the pieces in the same position during the recess. The problem is aggravated when using conventional pieces on a conventional board that is moved to a different location during the recess.

Accordingly, it is an important object of the invention to provide an improved game board.

It is a further object of the invention to achieve the preceding object with a game board that may be played with conventional pieces in a conventional manner having means for selectively retaining the pieces at prescribed locations during a recess, even when the game board is moved.

It is a further object of the invention to achieve one or more of the preceding objects with an attractive game board that is relatively easy to operate by relatively unskilled personnel.

It is a further object of the invention to achieve one or more of the preceding objects with a rugged structure capable of reliable operation over long periods of time.

SUMMARY OF THE INVENTION

According to the invention, there is means defining a plurality of game piece locations that are supported on a base to define recesses between adjacent piece location defining means, and displaceable means having a plurality of elements normally residing in said recesses during play and means for selectively displacing the element to a stable position outside said recesses to define cells surrounding the region above each piece location for accommodating a piece therein.

Numerous other features, objects and advantages of the invention will become apparent from the following specification when read in connection with the accompanying drawing in which:

BRIEF DESCRIPTION OF THE DRAWING

FIG. 3 is a top view of a corner;

FIG. 4 is an elevation view of the corner with the egg-crate structure raised;

FIG. 5 is a fragmentary elevation view of a block helpful in understanding how the structure remains in a stable elevated position;

FIG. 6 is a fragmentary elevation view of blocks illustrating how they are fastened to the base;

FIG. 7 is a view partially in section illustrating how the rawhide handle may be secured; and FIGS. 8–10 illustrate an alternate embodiment of the invention in which a steel corner bracket with a partial corner cutout in the corner blocks and a magnet at the top keeps the egg-crate structure in a stable elevated position.

DETAILED DESCRIPTION OF PREFERRED EMBODIMENTS

Figure 1:
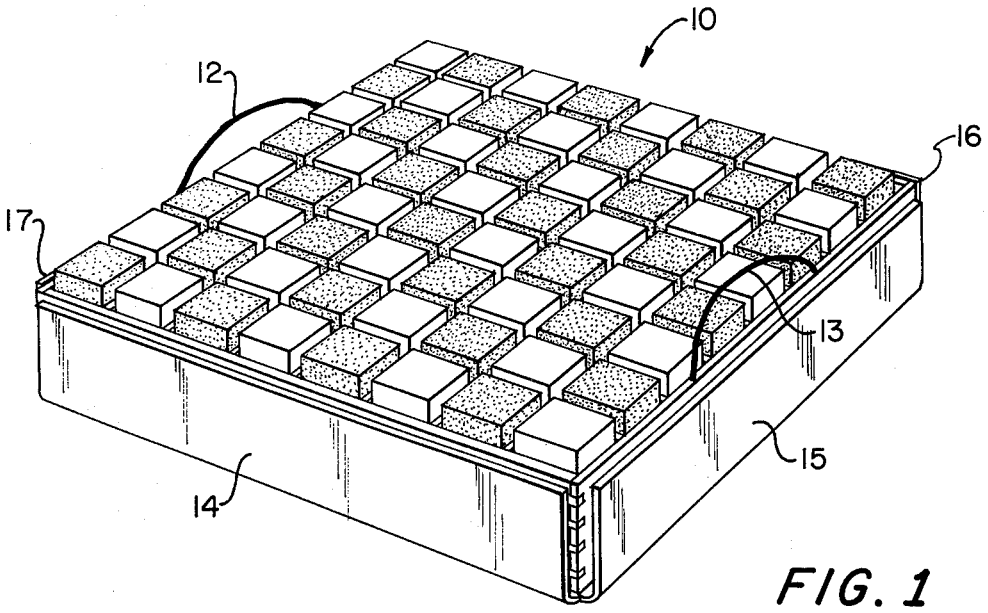
FIG. 1 is a perspective view of an embodiment of the invention in normal playing position.
Figure 2:
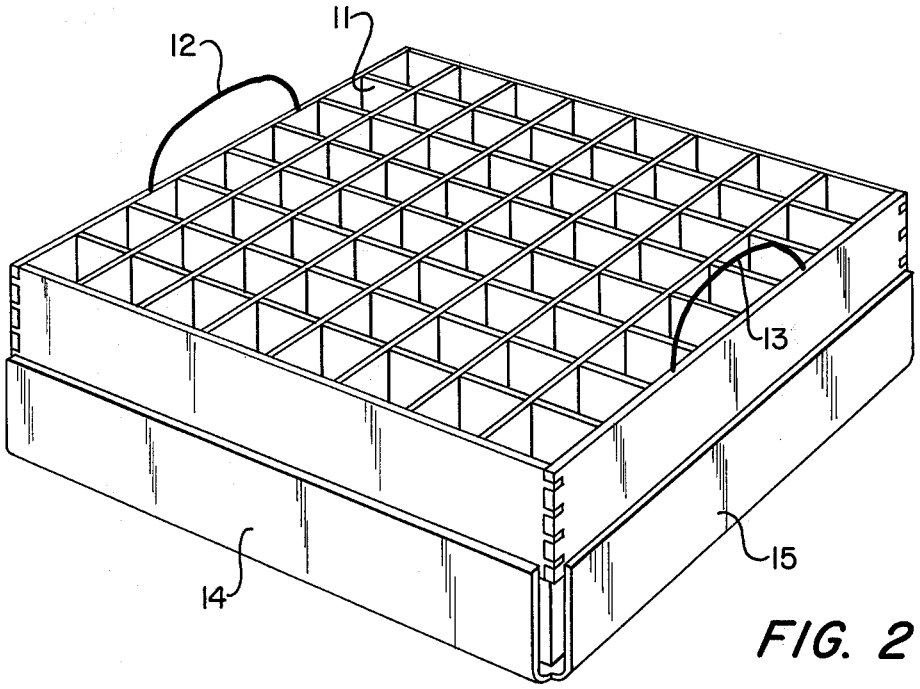
FIG. 2 is a perspective view of the embodiment of FIG. 1 with the egg-crate structure for surrounding game pieces raised.

With reference now to the drawing, and more particularly FIGS. 1 and 2 thereof, there is shown a perspective view of an embodiment of the invention comprising a chess board with each square being defined by the top of an individual block secured to a base (not shown in FIG. 1) to define cross-hatched recesses for accommodating an egg-crate raisable structure 11 that may rise to a stable position as shown in FIG. 2 when handles 12 and 13 are raised that are attached to the egg-crate structure 11. The embodiment includes four side panels 14, 15, 16 and 17 that may be separately or integrally formed with the base.

Referring to FIG. 3, there is shown a plan view of the corner between sides 14 and 15. Corner block 21 or an inner peripheral block is formed with a stopped groove 22 for accommodating pin 23 that is secured to side 24 of egg-crate structure 11 to allow vertical movement of egg-crate structure 11 to its limit but preventing separation from the base. Preferably, there are similar pin-and-groove structures in each of the four corner blocks or an inner pair of symmetrically disposed peripheral blocks.

Referring to FIG. 4, there is shown an elevation view partially in section of corner block 23 with structure 11 in the raised position. The slats such as 25 are preferably assembled with half lap joints. Block 21 rests on base 26.

Referring to FIG. 5, there is shown an elevation view of block 21 looking toward the face having groove 22 to illustrate how pin 23 may be accommodated between flexible tubes 27 and 28 to keep egg-crate structure 11 in the elevated position.

Referring to FIG. 6, there is shown an elevation view of block 21 and a neighboring block 31 partially in section helpful in understanding how the blocks such as 21 and 31 are fastened to base 26 by fasteners such as 32 and 33, respectively, typically drive screws. The slat 34 resides in the recess 35 between blocks 21 and 31.

Referring to FIG. 7, there is shown a view partially in section through the plane including the edge of handle 13 to illustrate how rawhide handle 13 may extend through a recess 37 in side 24 and have a knot 36 at its end which applies a raising force to side 24 when handle 13 is pulled up.

Referring to FIGS. 8, 9 and 10, there is shown a view of the corner of an embodiment of the invention in which block 21' is formed with a partial corner cutout 41 for accommodating at the top a steel corner bracket 42 which is attached to the corner of egg-crate structure 11 with a magnet 43 at the top of cutout 41 holding egg-crate structure 11 in the elevated position. The other three corners may be arranged similarly in the embodiment of FIGS. 8–10. Other structural arrangements may be used within the principles of the invention.

The invention has a number of advantages. With egg-crate structure 11 recessed the invention provides an attractive chess or checker board that is easy to play upon with conventional pieces. When the game is adjourned, one need only raise handles 12 and 13 to bring the egg-crate structure 11 into a stable elevated position surrounding the pieces. The assembly may then be conveniently carried to a storage location until the game is resumed.

There has been described novel apparatus and techniques for selectively retaining game pieces in an attractive assembly that is easily and conveniently transportable between playing and storage locations. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Game piece retaining apparatus comprising, a plurality of blocks each having a top surface for defining a game piece location, a base, means for securing said blocks to said base to define a plurality of recesses between adjacent blocks, a plurality of interconnected slats normally residing in said recesses when a game is being played on said game piece locations, and means for selectively displacing said interconnected slats from said first-mentioned position in said recesses to a second stable position above said recesses to define a plurality of cells each surrounding a respective region above a game piece location for confining a game piece to a game piece location when said interconnected slats are in the lastmentioned position above said recesses.

2. Game piece retaining apparatus in accordance with claim 1 and further including handle means attached to said interconnected slats for raising said interconnected slats to the last-mentioned position.

3. Game piece retaining apparatus in accordance with claim 1 wherein said top surfaces are substantially in a common normally horizontal plane.

4. Game piece retaining apparatus in accordance with claim 1 wherein the means for establishing the last-mentioned position stable comprises pin means accommodated between flexible gripping jaws.

5. Game piece retaining apparatus in accordance with claim 1 wherein the means for establishing the last-mentioned position stable comprises a magnetic metal piece and a permanent magnet.

6. Game piece retaining apparatus in accordance with claim 1 wherein the means for securing each block to said base is a single pin.

7. Game piece retaining apparatus in accordance with claim 1 wherein said top surfaces are substantially in a common normally horizontal plane and substantially square to define a checker or chess board.

* * * * *